US012560334B2

(12) United States Patent
Ho et al.

(10) Patent No.: US 12,560,334 B2
(45) Date of Patent: Feb. 24, 2026

(54) OVEN APPLIANCES AND METHODS OF MONITORING COOKING UTENSILS THEREIN

(71) Applicant: Haier US Appliance Solutions, Inc., Wilmington, DE (US)

(72) Inventors: Yuen-Pik Ho, Louisville, KY (US); Wei Zhou, Louisville, KY (US); Robert John Zanelli, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 737 days.

(21) Appl. No.: 17/894,442

(22) Filed: Aug. 24, 2022

(65) Prior Publication Data

US 2024/0068670 A1 Feb. 29, 2024

(51) Int. Cl.
*F24C 7/08* (2006.01)
*F24C 3/12* (2006.01)

(52) U.S. Cl.
CPC ..... *F24C 7/085* (2013.01); *F24C 3/128* (2013.01); *F24C 7/086* (2013.01)

(58) Field of Classification Search
CPC ..... F24C 7/085; F24C 7/086; F24C 3/128
See application file for complete search history.

(56) References Cited

U.S. PATENT DOCUMENTS

| | | | | |
|---|---|---|---|---|
| 6,462,316 | B1 | 10/2002 | Berkcan et al. | |
| 7,525,074 | B2 | 4/2009 | Bostick et al. | |
| 8,696,827 | B2 | 4/2014 | Ashrafzadeh et al. | |
| 10,025,282 | B1 | 7/2018 | Wilkinson | |
| 10,760,794 | B2 | 9/2020 | Cheng | |
| 2010/0182136 | A1 | 7/2010 | Pryor | |
| 2014/0014647 | A1 | 1/2014 | Brosnan et al. | |
| 2018/0324908 | A1 | 11/2018 | Denker et al. | |
| 2018/0372332 | A1 | 12/2018 | Cha et al. | |
| 2020/0069111 | A1 * | 3/2020 | Eiter | F24C 7/085 |
| 2021/0186262 | A1 | 6/2021 | Sun et al. | |
| 2021/0207811 | A1 | 7/2021 | Adam et al. | |
| 2023/0341129 | A1 * | 10/2023 | Taylor | F24C 7/082 |

FOREIGN PATENT DOCUMENTS

| | | | |
|---|---|---|---|
| CN | 104102164 | A | 10/2014 |
| CN | 105526614 | A | 4/2016 |
| CN | 106369639 | A | 2/2017 |

(Continued)

*Primary Examiner* — Thien S Tran

(74) *Attorney, Agent, or Firm* — Dority & Manning, P.A.

(57) ABSTRACT

An oven appliance may include a cabinet, a heating element, and a controller. The cabinet may define a cooking chamber. The heating element may be in thermal communication with the cooking chamber to heat a cooking utensil therein. The controller may be in operable communication with the heating element. The controller may be configured to initiate a directed cooking operation. The directed cooking operation may include capturing a first image of the cooking chamber, identifying the cooking utensil within the cooking chamber based on the captured first image, capturing a second image of the cooking chamber following capturing the first image, detecting changes in the cooking utensil based on the captured second image, and directing oven operation based on the detected changes.

16 Claims, 4 Drawing Sheets

(56) References Cited

FOREIGN PATENT DOCUMENTS

| | | | | | |
|---|---|---|---|---|---|
| CN | 106854807 | A | | 6/2017 | |
| CN | 207199040 | U | | 4/2018 | |
| CN | 110262581 | A | | 9/2019 | |
| CN | 110702559 | A | | 1/2020 | |
| CN | 110848755 | A | * | 2/2020 | ..... F24C 3/126 |
| CN | 109654559 | A | | 4/2020 | |
| CN | 107990383 | B | | 4/2021 | |
| CN | 114060866 | A | * | 2/2022 | ..... F24C 3/126 |
| DE | 102015201079 | A1 | | 9/2015 | |
| DE | 102015104631 | A1 | | 9/2016 | |
| DE | 102019105407 | A1 | | 9/2020 | |
| DE | 102020203763 | A1 | | 10/2020 | |
| EP | 1505350 | B1 | | 12/2009 | |
| JP | 2021012841 | A | | 2/2021 | |
| KR | 20160069359 | A | | 6/2016 | |
| KR | 101671805 | B1 | | 11/2016 | |
| KR | 101791498 | B1 | | 10/2017 | |
| WO | WO-2022076013 | A1 | * | 4/2022 | ..... F24C 7/082 |

* cited by examiner

OVEN APPLIANCES AND METHODS OF MONITORING COOKING UTENSILS THEREIN

FIELD OF THE INVENTION

The present subject matter relates generally to oven appliances, and more particularly to appliances and methods for detecting or monitoring cooking utensils within a cooking appliance.

BACKGROUND OF THE INVENTION

Oven appliances generally include a cabinet that defines a cooking chamber for cooking food items therein, such as by baking or broiling the food items. In order to perform the cooking operation, oven appliances typically include one or more heat sources, or heating elements, provided in various locations within the cabinet or cooking chamber. These heat sources may be used together or individually to perform various specific cooking operations, such as baking, broiling, roasting, and the like.

Irrespective of the configuration of the oven appliance itself, it is common for users of an oven appliance to use various types of cookware or cooking utensils (e.g., pots, pans, griddles, dishes, etc.) comprising various types of materials (e.g., stainless steel, aluminum, cast iron, etc.). One of the common difficulties for users is knowing how to properly use these various utensils. In particular, different utensils can respond to the heat of a cooking chamber in significantly different ways. As a result, it is easy for a user to accidentally damage a utensil, for example, by using it inappropriately (e.g., at too high of a heat, with another unsuitable item, etc.). Along with impacting the life of the cookware, insufficient knowledge of the cookware may negatively impact the taste and desirability of any food that the cookware is used with.

As a result, there is a need for a cooking assembly or method that can adapt or guide a user in the use of various types of cookware or cooking utensils. In particular, it would be advantageous if an oven appliance could guide a user or prevent damage to a cooking utensil without requiring direct user input or knowledge of the characteristics the particular utensil being used.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a heating element, and a controller. The cabinet may define a cooking chamber. The heating element may be in thermal communication with the cooking chamber to heat a cooking utensil therein. The controller may be in operable communication with the heating element. The controller may be configured to initiate a directed cooking operation. The directed cooking operation may include capturing a first image of the cooking chamber, identifying the cooking utensil within the cooking chamber based on the captured first image, capturing a second image of the cooking chamber following capturing the first image, detecting changes in the cooking utensil based on the captured second image, and directing oven operation based on the detected changes.

In another exemplary aspect of the present disclosure, a method of operating an oven appliance is provided. The method may include capturing a first image of a cooking chamber and identifying a cooking utensil within the cooking chamber based on the captured first image. The method may further include capturing a second image of the cooking chamber following capturing the first image and detecting changes in the cooking utensil based on the captured second image. The method may still further include directing oven operation based on the detected changes.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
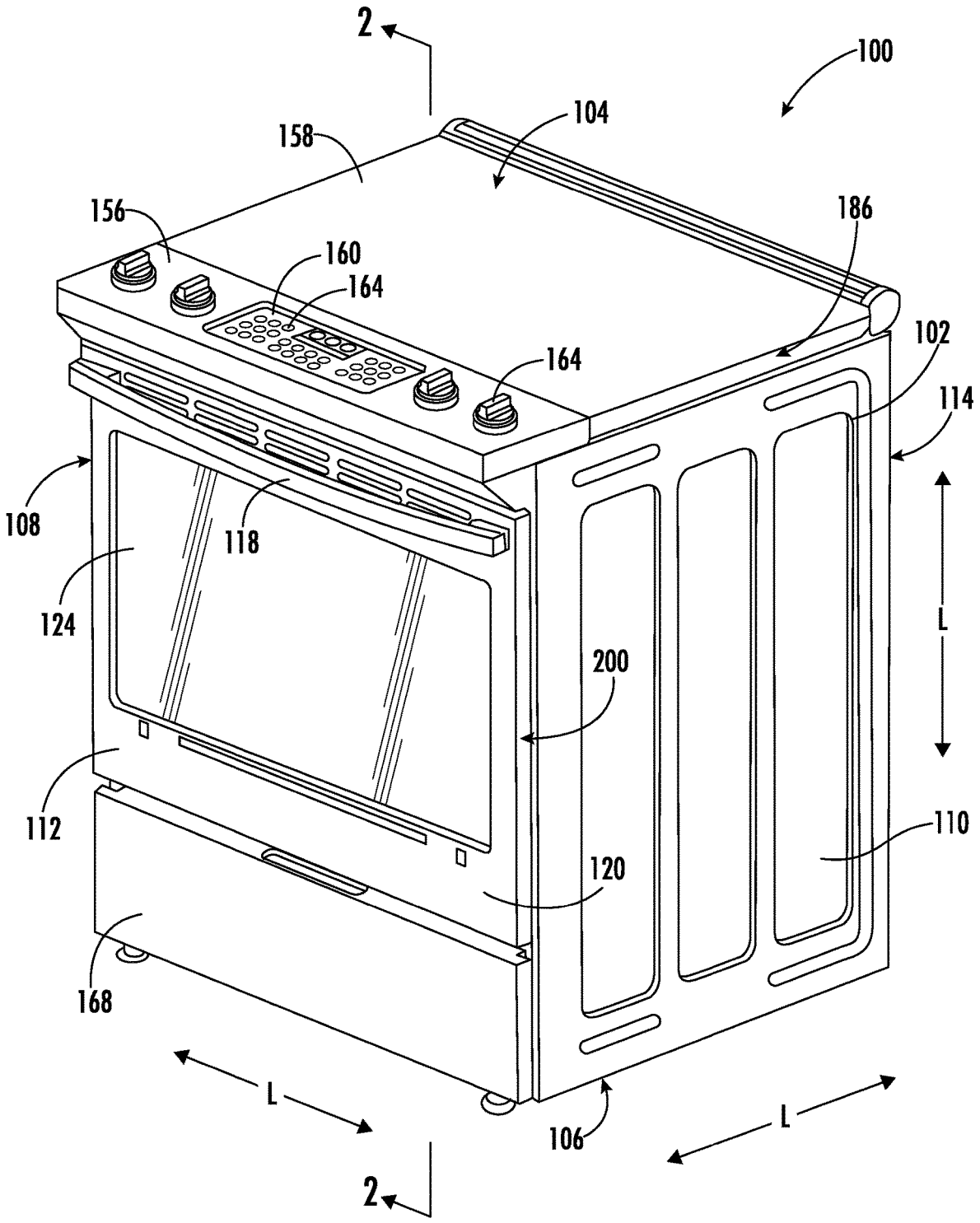
FIG. 1 provides a perspective view of an oven appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Terms such as "inner" and "outer" refer to relative directions with respect to the interior and exterior of the oven appliance, and in particular the chamber(s) defined therein. For example, "inner" or "inward" refers to the direction towards the interior of the oven appliance. Terms such as "left," "right," "front," "back," "top," or "bottom" are used with reference to the perspective of a user accessing the appliance (e.g., when the door is in the closed position). For example, a user stands in front of the appliance to open a door and reaches into the cooking chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise, or counterclockwise, with the vertical direction V).

Embodiments described herein may include an oven appliance or method for automatically (e.g., without direct user intervention or action) detecting changes to a cooking utensil within an oven. For instance, a camera may be used to track the changes in a cooking utensil while it is being heated. Detected changes in the cooking utensil may cause the oven to issue an alert or otherwise adjust cooking actions from the oven.

Figure 2:
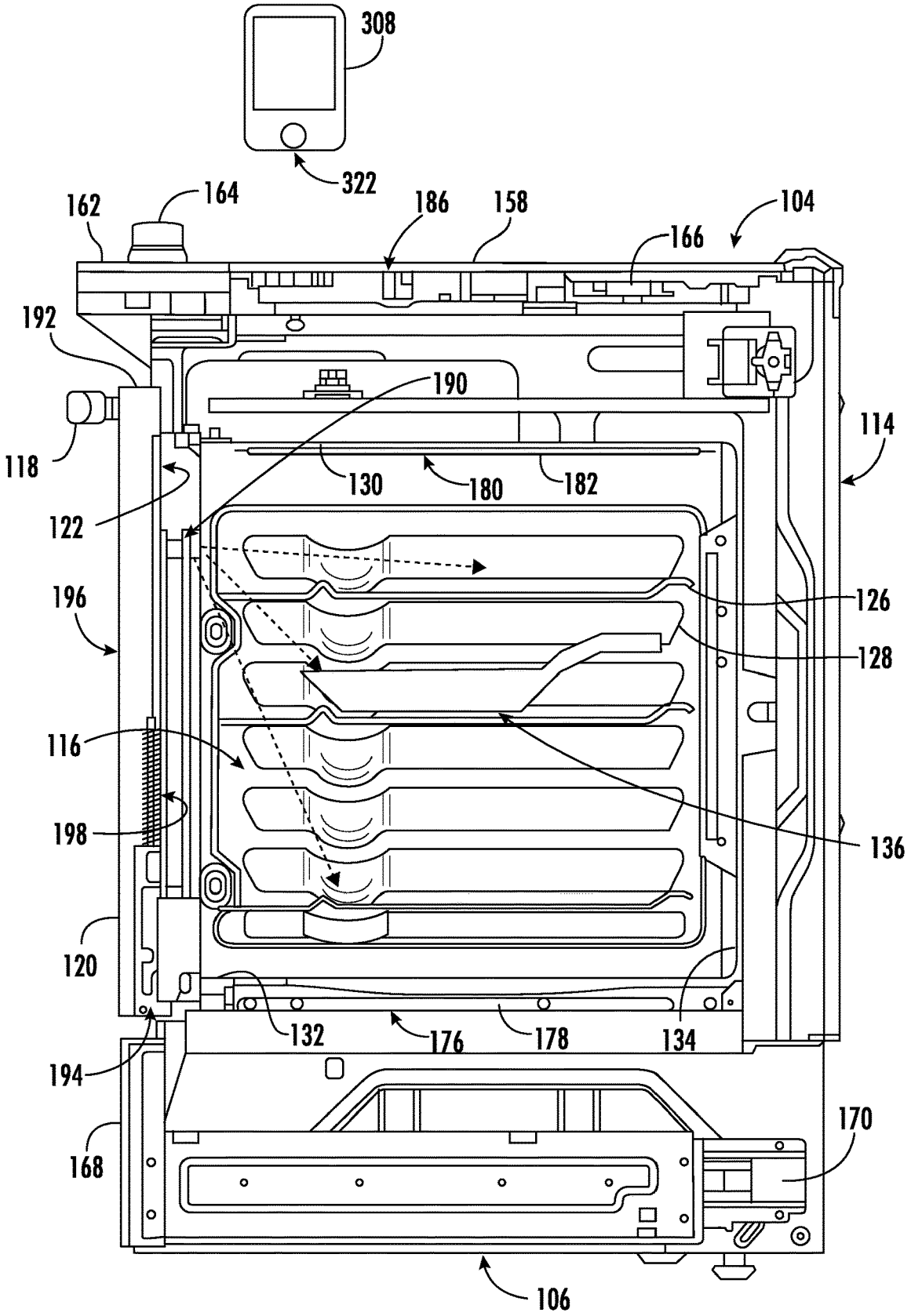
FIG. 2 provides a side, cross sectional view of the exemplary oven appliance of FIG. 1 in communication with a remote device.

Referring now to the figures, an exemplary appliance will be described in accordance with exemplary aspects of the present subject matter. Specifically, FIG. 1 provides a perspective view of an exemplary oven appliance 100 and FIG. 2 provides a side cross-sectional view of oven appliance 100. As illustrated, oven appliance 100 generally defines a vertical direction V, a lateral direction L, and a transverse direction T, each of which is mutually perpendicular, such that an orthogonal coordinate system is generally defined.

According to exemplary embodiments, oven appliance 100 includes a cabinet 102 that is generally configured for containing or supporting various components of oven appliance 100 and which may also define one or more cooking chambers or compartments of oven appliance 100. In this regard, as used herein, the terms "cabinet," "housing," and the like are generally intended to refer to an outer frame or support structure for oven appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of oven appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along vertical direction V, between a first side 108 (e.g., the left side when viewed from the front as in FIG. 1) and a second side 110 (e.g., the right side when viewed from the front as in FIG. 1) along lateral direction L, and between a front 112 and a rear 114 along transverse direction T.

Oven appliance 100 includes an internal cooking chamber 116 disposed or defined within cabinet 102. Cooking chamber 116 may be insulated. In some embodiments, cooking chamber 116 is configured for the receipt of one or more items to be cooked, including food items. Cabinet 102 defines cooking chamber 116 between a top wall 130 and a bottom wall 132. Oven appliance 100 includes a door 120 rotatably mounted to cabinet 102 (e.g., with a hinge). A handle 118 is mounted to door 120 and assists a user with opening and closing door 120 in order to access cooking chamber 116. For example, a user can pull on handle 118 to open or close door 120 and access cooking chamber 116 through a resultant opening. As would be understood, one or more internal heating elements (e.g., baking heating elements 178 or broiling heating elements 182) may be provided in thermal communication with (e.g., within or in convective thermal communication with) cooking chamber 116 to cook or otherwise heat items therein.

Oven appliance 100 can include a seal 122 (e.g., gasket) between door 120 and cabinet 102 that assists with maintaining heat and cooking fumes within cooking chamber 116 when door 120 is closed as shown. Door 120 may include a window 124, constructed for example from multiple parallel glass panes (e.g., glass panels 238, 240) to provide for viewing contents of cooking chamber 116 when door 120 is closed and assist with insulating cooking chamber 116. A baking rack 126 may be positioned in cooking chamber 116 for the receipt of food items or utensils containing food items. Baking rack 126 may be slidably received onto embossed ribs 128 or sliding rails such that baking rack 126 may be conveniently moved into and out of cooking chamber 116 when door 120 is open.

Generally, various sidewalls define cooking chamber 116. For example, cooking chamber 116 includes a top wall 130 and a bottom wall 132 that are spaced apart along vertical direction V. Left and right sidewalls extend between top wall 130 and bottom wall 132, and are spaced apart along lateral direction L. A rear wall 134 may additionally extend between top wall 130 and bottom wall 132 as well as between the left and right sidewalls, and is spaced apart from door 120 along transverse direction T.

In some examples, top 104 includes a front panel 156 or cooktop panel 158. Front panel 156 may be located transversely forward of cooktop panel 158. Front panel 156 may house a controller 162 or controls 164, as described in more detail below. Additionally or alternatively, cooktop panel 158 may be proximal to a plurality of heating assemblies 166, as described in more detail below.

A lower heating assembly (e.g., bake heating assembly 176) may be positioned in oven appliance 100, and may include one or more heating elements (e.g., bake heating elements 178). Bake heating elements 178 may be disposed within cooking chamber 116, such as adjacent bottom wall 132. In exemplary embodiments as illustrated, bake heating elements 178 are electric heating elements, as is generally understood. Alternatively, bake heating elements 178 may be gas burners or other suitable heating elements having other suitable heating sources. Bake heating elements 178 may generally be used to heat cooking chamber 116 for both cooking and cleaning of oven appliance 100.

Additionally or alternatively, an upper heating assembly (e.g., broil heating assembly 180) may be positioned in oven appliance 100, and may include one or more upper heating elements (e.g., broil heating elements 182). Broil heating elements 182 may be disposed within cooking chamber 116, such as adjacent top wall 130. In exemplary embodiments as illustrated, broil heating elements 182 are electric heating elements, as is generally understood. Alternatively, broil heating elements 182 may be gas burners or other suitable heating elements having other suitable heating sources. Broil heating elements 182 may additionally be used to heat cooking chamber 116 for both cooking and cleaning of oven appliance 100.

In some embodiments, oven appliance 100 includes a cooktop 186 positioned at cooktop panel 158 of oven appliance 100. In such embodiments, cooktop panel 158 may be a generally planar member having an upward surface that is perpendicular to vertical direction V. In particular, cooktop panel 158 may be formed from glass, glass ceramic, metal, or another suitable material. A plurality of heating assemblies (e.g., cooktop heating assemblies 166) may be mounted to or otherwise positioned on cooktop panel 158. In some embodiments, cooktop heating assemblies 166 are positioned above cooking chamber 116 of cabinet 102 (i.e., higher relative to vertical direction V). Optionally, cooktop heating assemblies 166 may extend between cooking chamber 116 and cooktop panel 158, within an open region that is defined between cooktop panel 158 and cooking chamber 116. Cooking utensils, such as pots, pans, griddles, etc., may be placed on cooktop panel 158 and heated with heating assemblies 166 during operation of cooktop 186. In FIGS. 1 and 2, cooktop heating assemblies 166 are shown as radiant heating elements mounted below cooktop panel 158. However, in alternative example embodiments, cooktop heating assemblies 166 may be any suitable heating assembly, such as gas burner elements, resistive heating elements, induction heating elements, or other suitable heating elements.

Door 120 is mounted on cabinet 102 below cooktop panel 158 to selectively allow access to cooking chamber 116. As may be seen in FIG. 2, door 120 extends between a top lip 192 and a bottom lip 194 (e.g., along vertical direction V when door 120 is in the closed position). Door 120 may further extend between a front surface 196 and a rear surface 198 (e.g., along transverse direction T when door 120 is in the closed position). Handle 118 may be provided on door 120 proximal to top lip 192.

In some embodiments, oven appliance 100 includes a drawer 168 movably mounted to cabinet 102. For instance, drawer 168 may be slidably mounted to cabinet 102 to selectively move forward/rearward along transverse direction T. One or more slidable rails, bearings, or assemblies 170 may be installed or mounted between drawer 168 and cabinet 102 to facilitate movement of drawer 168 relative to cabinet 102, as would be understood. As shown, drawer 168 may be disposed generally below cooking chamber 116. In particular, drawer 168 may be disposed below door 120.

Oven appliance 100 is further equipped with a controller 162 to regulate operation of oven appliance 100. For example, controller 162 may regulate the operation of oven appliance 100, including activation of heating elements (e.g., baking heating elements 178, broiling heating elements 180) as well as heating assemblies 166, 176, 180 generally. Controller 162 may be in operable communication (e.g., via a suitable electronic wired connection) with the heating elements and other components of oven appliance 100, as discussed herein. In general, controller 162 may be operable to configure oven appliance 100 (and various components thereof) for cooking. Such configuration may be based on a plurality of cooking factors of a selected operating cycles, sensor feedback, etc.

By way of example, controller 162 may include one or more memory devices (e.g., non-transitive media) and one or more microprocessors, such as general or special purpose microprocessors operable to execute programming instructions or micro-control code associated with an operating cycle. The memory may represent random access memory such as DRAM or read only memory such as ROM or FLASH. In exemplary embodiments, the processor executes programming instructions stored in memory. The memory may be a separate component from the processor or may be included onboard within the processor.

Controller 162 may be positioned in a variety of locations throughout oven appliance 100. For instance, controller 162 may be located within a user interface or control panel 160 of oven appliance 100, as shown in FIG. 2. In some such embodiments, input/output ("I/O") signals may be routed between the control system and various operational components of oven appliance 100 along wiring harnesses that may be routed through cabinet 102. In some embodiments, controller 162 is in operable communication (e.g., electronic or wireless communication) with user interface panel 160 and controls 164, through which a user may select various operational features and modes and monitor progress of oven appliance 100. In optional embodiments, user interface panel 160 may represent a general purpose I/O ("GPIO") device or functional block. In certain embodiments, user interface panel 160 includes input components or controls 164, such as one or more of a variety of electrical, mechanical, or electro-mechanical input devices including rotary dials, push buttons, and touch pads. Additionally or alternatively, user interface panel 160 may include a display component, such as a digital or analog display device designed to provide operational feedback to a user. User interface panel 160 may be in operable communication with controller 162 via one or more signal lines or shared communication busses.

Furthermore, the user interface panel 160 is located within convenient reach of a user of appliance. User interface panel 160 includes various input components, such as one or more of a variety of touch-type controls 164, electrical, mechanical, or electro-mechanical input devices including knobs, rotary dials, push buttons, and touch pads. The user interface panel 160 may include a display component, such as a digital or analog display device, designed to provide operational feedback to a user.

Various appliance features of appliance may be activated/deactivated by a user manipulating the input components on user interface panel 160. Thus, for example, when appliance is a cooktop 186 or oven appliance 100, a user may manipulate knobs or buttons on user interface panel 160 to activate and deactivate heating elements of appliance 100. As another example, a user of appliance may set a timer on user interface panel 160.

In certain embodiments, a discrete interior camera assembly 190 is secured (e.g., directly or indirectly) to cabinet 102 and in operable communication with controller 162 to capture images (e.g., static images or dynamic video) of a portion of oven appliance 100 (e.g., within cooking chamber 116).

Generally, interior camera assembly 190 may be any type of device suitable for capturing a picture or video. As an example, interior camera assembly 190 may be a video camera or a digital camera with an electronic image sensor [e.g., a charge coupled device (CCD) or a CMOS sensor]. Interior camera assembly 190 may be in operable communication with controller 162 such that controller 162 can receive an image signal (e.g., video signal) from interior camera assembly 190 corresponding to the image(s) captured by interior camera assembly 190. Once received by controller 162, the image signal (e.g., video signal) may be further processed at controller 162 or transmitted to a separate device (e.g., remote server 304) "live" or in real-time for remote viewing (e.g., via a user or remote device 308). Optionally, one or more lights may be included with camera assembly 190 or elsewhere within chamber 116 to illuminate the cooking zone or chamber 116 generally, as would be understood.

As shown, interior camera assembly 190 may be secured to cabinet 102 (e.g., directly or indirectly). In some embodiments, interior camera assembly 190 is directed at a portion of cooking chamber 116. For instance, interior camera assembly 190 may be mounted to door 120 (e.g., at an interior surface thereof) to capture the cooking zone defined by one or more racks 126 within cooking chamber 116, as shown. Alternatively, though, interior camera assembly 190 may be mounted to another suitable structure, such as the top wall 130 of cabinet 102, wherein the camera assembly 190 directed downward.

Figure 4:
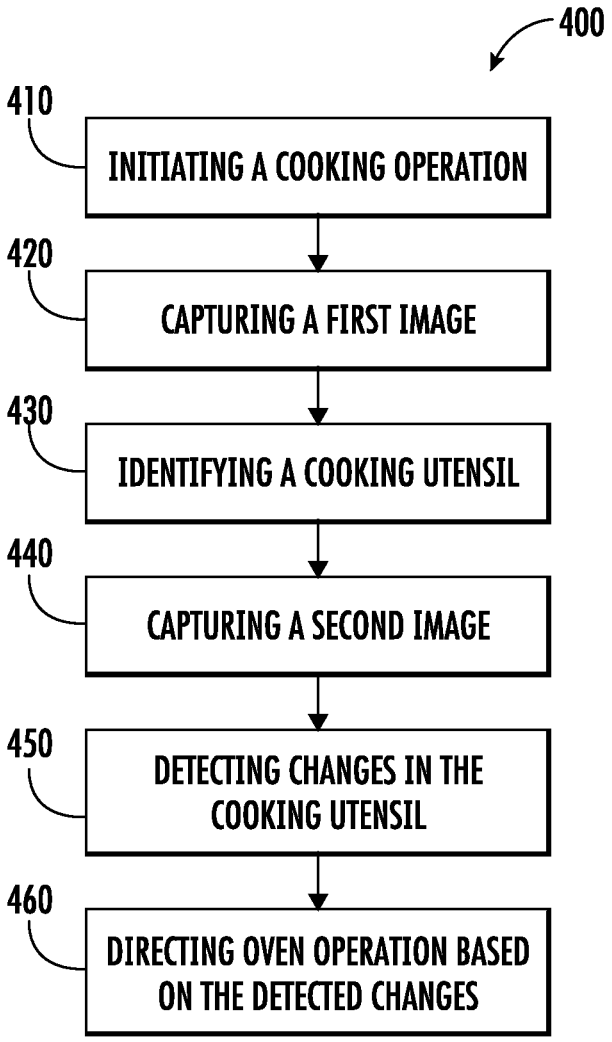
FIG. 4 a flow chart illustrating a method of operating an oven appliance according to exemplary embodiments of the present disclosure.

As would be understood, rack 126 may be positioned (e.g., slidably positioned) in cooking chamber 116 to define a cooking zone for receipt of food items or cooking utensils 136. When assembled, interior camera assembly 190 may thus capture light emitted or reflected from the cooking zone through the cooking chamber 116. In some such embodiments, interior camera assembly 190 can selectively capture an image covering all or some of the horizontal support surface define by rack 126. Optionally, interior camera assembly 190 may be directed such that a line of sight is defined from interior camera assembly 190 that is non-parallel to the horizontal support surface define by rack 126. Thus, the real-time video feed may include a digital picture or representation of the cooking zone or utensil 136 (e.g., as illustrated in FIG. 4).

During use, objects (e.g., cooking utensil 136) placed on one of the rack 126 (or otherwise between the cooking zone and interior camera assembly 190) may be captured (e.g., as a video feed or series of sequential static images) and transmitted to another portion of the oven appliance 100 (e.g., controller 162), as is generally understood. From the captured images, a cookware item or cooking utensil 136 within the field of view for the camera assembly 190 may be automatically detected or identified (e.g., by the controller 162). As would be understood, detecting or identifying such items, may be performed by one or more suitable image analysis algorithms (e.g., executed at the controller 162 or a remote server 304 based on one or more captured images from camera 190).

Figure 3:
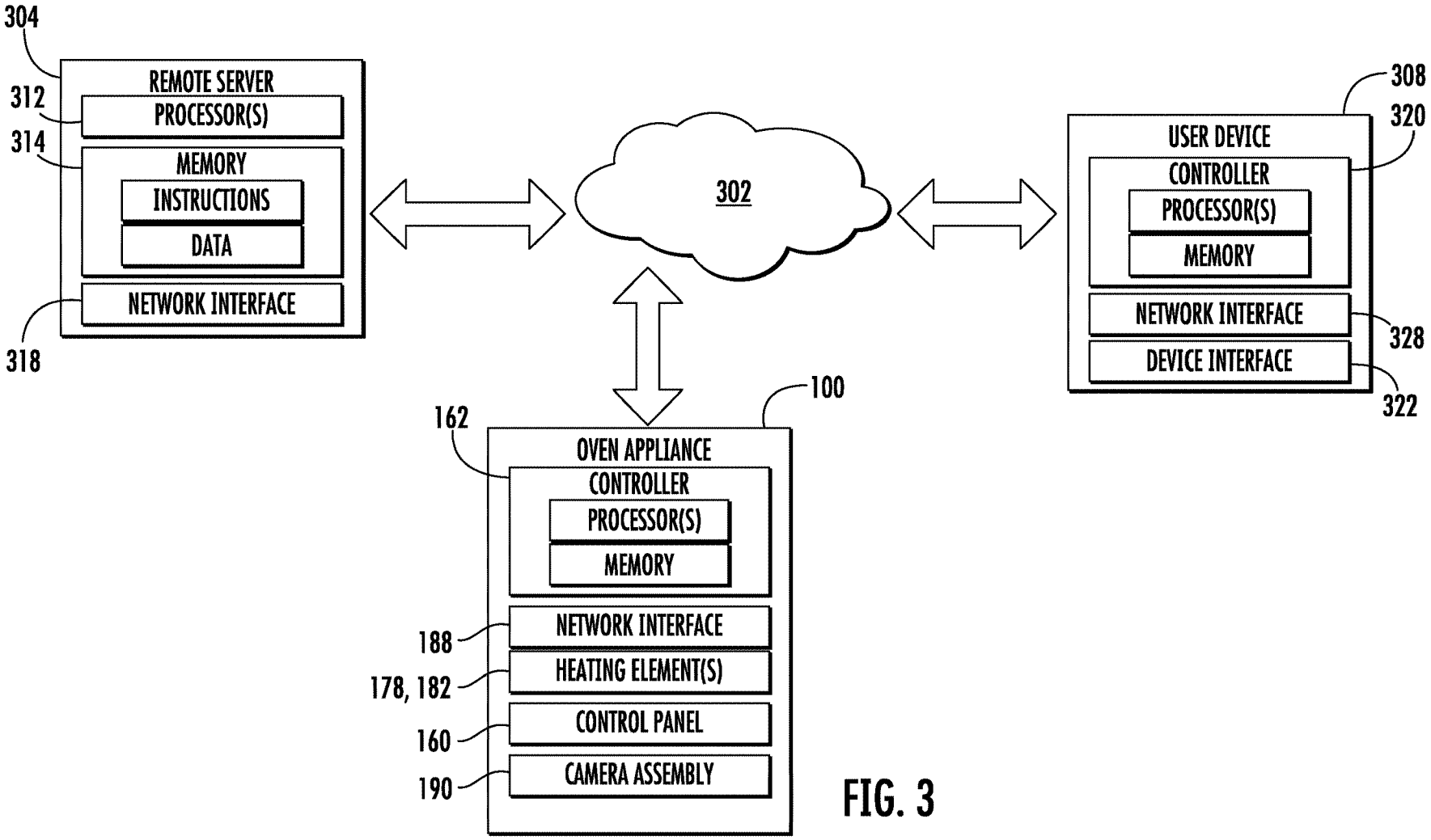
FIG. 3 provides a schematic view of a system for engaging a cooking appliance according to exemplary embodiments of the present disclosure.

Turning especially to FIG. 3, a schematic view is provided of a system, illustrating cooking appliance 100, one or more remote servers 304, and one or more user devices 308. As shown, cooking appliance 100 can be communicatively coupled with a network 302 and various other nodes, such as a remote server 304 and a user device 308.

In some embodiments, controller 162 includes a network interface 188 such that controller 162 can connect to and communicate over one or more networks (e.g., network 302) with one or more network nodes. Controller 162 can also include one or more transmitting, receiving, or transceiving components for transmitting/receiving communications with other devices communicatively coupled with cooking appliance 100. Additionally or alternatively, one or more transmitting, receiving, or transceiving components can be located off board controller 162.

Network 302 can be any suitable type of network, such as a local area network (e.g., intranet), wide area network (e.g., internet), low power wireless networks [e.g., Bluetooth Low Energy (BLE)], or some combination thereof and can include any number of wired or wireless links. In general, communication over network 302 can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL).

In some embodiments, a remote server 304, such as a web server, is in operative communication with cooking appliance 100. The server 304 can be used to host an information database (e.g., image database, user database, etc.). The server 304 can be implemented using any suitable computing device(s). The server 304 may include one or more processors 312 and one or more memory devices 314 (i.e., memory). The one or more processors 312 can be any suitable processing device (e.g., a processor core, a microprocessor, an ASIC, a FPGA, a microcontroller, etc.) and can be one processor or a plurality of processors that are operatively connected. The memory device 314 can include one or more non-transitory computer-readable storage mediums, such as RAM, ROM, EEPROM, EPROM, flash memory devices, magnetic disks, etc., and combinations thereof. The memory devices 314 can store data and instructions which are executed by the processor 312 to cause remote server 304 to perform operations. For example, instructions could be instructions for receiving/transmitting images or image signals, analyzing image signals, transmitting/receiving alert signals, etc.

The memory devices 314 may also include data, such as image data, video data, historical use data, etc., that can be retrieved, manipulated, created, or stored by processor 312. The data can be stored in one or more databases. The one or more databases can be connected to remote server 304 by a high bandwidth LAN or WAN, or can also be connected to remote server 304 through network 302. The one or more databases can be split up so that they are located in multiple locales.

Remote server 304 includes a network interface 318 such that remote server 304 can connect to and communicate over one or more networks (e.g., network 302) with one or more network nodes. Network interface 318 can be an onboard component or it can be a separate, off board component. In turn, remote server 304 can exchange data with one or more nodes over the network 302. In particular, remote server 304 can exchange data with cooking appliance 100 or user device 308. Although not pictured, it is understood that remote server 304 may further exchange data with any number of client devices over the network 302. The client devices can be any suitable type of computing device, such as a general purpose computer, special purpose computer, laptop, desktop, integrated circuit, mobile device, smartphone, tablet, or other suitable computing device.

In certain embodiments, a user device 308 is communicatively coupled with network 302 such that user device 308 can communicate with cooking appliance 100. For instance, user device 308 can communicate directly with cooking appliance 100 via network 302. Alternatively, a user can communicate indirectly with cooking appliance 100 by communicating via network 302 with remote server 304 (e.g., directly or indirectly through one or more intermediate remote servers), which in turn communicates with cooking appliance 100 via network 302. Moreover, a user can be in operative communication with user device 308 such that the user can communicate with cooking appliance 100 via user device 308.

User device 308 can be any type of remote device, such as, for example, a personal computing device (e.g., laptop or desktop), a mobile computing device (e.g., smartphone or tablet), a gaming console or controller, a wearable computing device, an embedded computing device, a remote, or any other suitable type of user computing device. User device 308 can include one or more user device controllers 320. Controller 320 can include one or more processors and one or more memory devices. The one or more processors can be any suitable processing device (e.g., a processor core, a microprocessor, an ASIC, a FPGA, a controller, a microcontroller, etc.) and can be one processor or a plurality of processors that are operatively connected. The memory device (i.e., memory) can include one or more non-transitory computer-readable storage mediums, such as RAM, ROM, EEPROM, EPROM, flash memory devices, magnetic disks, etc., and combinations thereof. The memory can store data and instructions which are executed by the processor to cause user device 308 to perform operations. Controller 320 a user device network interface 328 such that user device 308 can connect to and communicate over one or more networks (e.g., network 302) with one or more network nodes. Network interface 328 can be an onboard component of controller 320 or it can be a separate, off board component. Controller 320 can also include one or more transmitting, receiving, or transceiving components for transmitting/receiving communications with other devices communicatively coupled with user device 308. Additionally or alternatively, one or more transmitting, receiving, or transceiving components can be located off board controller 320.

User device 308 includes a device interface 322 having one or more user inputs such as, for example, buttons, one or more cameras, or a monitor configured to display graphical user interfaces or other visual representations to user. For example, the device interface 322 can include a display that can present or display graphical user interfaces corresponding to operational features of cooking appliance 100 such that user may manipulate or select the features to operate cooking appliance 100. The display of user device 308 can be a touch sensitive component (e.g., a touch-sensitive display screen or a touch pad) that is sensitive to the touch of a user input object (e.g., a finger or a stylus). For example, a user may touch the display with his or her finger and type in a series of numbers on the display. In addition, motion of the user input object relative to the display can enable user to provide input to user device 308. User device 308 may provide other suitable methods for providing input to user device 308 as well. Moreover, user device 308 can include one or more speakers, one or more cameras, or more than one microphones such that user device 308 is configured with voice control, motion detection, and other functionality.

Generally, a user may be in operative communication with cooking appliance 100 or one or more user devices 308. For instance, a user may wish to alternately operate cooking appliance 100 directly (e.g., through control panel 160) or remotely (e.g., through user device 308). In particular, a user may wish to control operational features that include activating portions of cooking appliance 100, selecting a temperature or heat setting for cooking appliance 100, or receiving one or more alert signals or messages relating to oven appliance 100.

Referring now to FIG. 4, various methods may be provided for use with oven appliance 100 (FIG. 1) in accordance with the present disclosure. In general, the various steps of methods as disclosed herein may, in exemplary embodiments, be performed by a controller (e.g., controller 162 or remote server 304) as part of an operation that the controller is configured to initiate or direct (e.g., a directed cooking operation). During such methods, the controller may receive inputs and transmit outputs from various components of the oven appliance 100. For example, the controller may send signals to and receive signals from remote server 304, camera assembly 190, control panel 160, or user device 308. In particular, the present disclosure is further directed to methods, as indicated by 400, for operating appliance 100. Such methods advantageously facilitate adaptive cooking that is responsive to changes in a cooking utensil 136 being used without requiring direct user input or knowledge of the characteristics the particular cooking utensil being used FIG. 4 depicts steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

At 410, the method 400 includes initiating a cooking operation. For instance, a user may activate one or more heating elements or otherwise direct the oven appliance to heat the cooking chamber, such as by selecting a mode of heating or temperature to which the cooking chamber is to be heated (e.g., selected at or otherwise received from the control panel of the appliance or at a user device). Thus, 410 may include receiving an activation signal to activate one or more heating elements in thermal communication with the cooking chamber, as would be understood.

At 420, the method includes capturing a first image of the cooking chamber, including a cooking utensil therein. For instance, 420 may include receiving an image signal from a camera assembly. For instance, the image signal may be received from a camera assembly directed at (or otherwise adjacent to) the cooking chamber of the cooking appliance (e.g., as described above). As described above, the camera assembly may be directed at the cooking zone within the cooking chamber. Moreover, the camera assembly may be directed toward the cooking zone such that a rack is within the line of sight of the camera assembly (e.g., to capture portion of the rack, which may receive a cooking utensil thereon). Thus, the image signal may generally correspond to a portion of the cooking chamber and any cooking utensil thereon. As would be understood, the image signal may include multiple sequenced images captured by the camera assembly.

Generally, the first image signal may be received in response to an image capture sequence initiated at the camera assembly. The image capture sequence may be initiated, for instance, following 410. As an example, 420 may be in response to receiving the activation signal at 410. Additionally or alternatively, the image capture sequence may be initiated in response to a triggering event (e.g., detected opening or closing of the door to the cooking chamber). In some embodiments, the image signal may be captured and transmitted by specific user input supplied to a user interface of the cooking appliance (e.g., at the control panel or user device). During the image capture sequence, a first image may be captured that includes a particular cooking utensil (e.g., placed on the rack of the cooking appliance or otherwise within the line of sight of the camera assembly). The first image may then be included with the image signal received at 420 (e.g., for further analysis at the appliance controller, remote server, etc.).

At 430, the method 400 includes identifying the cooking utensil within the cooking chamber based on the captured first image. In particular, the shape, color, or other physical characteristics of the cooking utensil may be identified via image analysis (e.g., initial image analysis).

According to exemplary embodiments, this image analysis may use any suitable image processing technique, image recognition process, etc. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to constantly or periodically monitor the cooking utensil. It should be appreciated that this image analysis or processing may be performed locally (e.g., by the appliance controller) or remotely (e.g., by offloading image data to the remote server or network).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the appliance controller based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

At 440, the method 400 includes capturing a second image of the cooking chamber, including the cooking utensil therein. Specifically, 440 may follow 420. For instance, following 420, 440 may include receiving another (e.g., second) image signal from the camera assembly. For instance, the image signal may be received from the same camera assembly as 420. Thus, the image signal may correspond to the same portion of the cooking chamber as the first image.

Generally, the second image signal may be received in response to an image capture sequence initiated at the camera assembly. This may be the same image capture sequence as that of 420 or, alternatively, a new sequence. In some embodiments, the 440 includes measuring a preset interval period following 420. For instance, the image capture sequence may have a preset interval or rate for image capture (e.g., frame rate). Thus, the image captured at 440 may be separated in time from the first image by at least one preset interval period.

At 450, the method 400 includes detecting changes in the cooking utensil based on the captured second image of 440. For instance, a second image analysis may be applied to the second image (e.g., as such image analysis is described above). Thus, 450 may include reidentifying the cooking utensil from the second image. Moreover, the shape, color, or other physical characteristics of the cooking utensil may be reidentified via image analysis (e.g., second image analysis). Once the cooking utensil is reidentified, a comparison may be made between the first and second analyses (i.e., between the identified cooking utensil of the first image and the reidentified cooking utensil of the second image).

Differences between the analyzed attributes and, thus, changes in the cooking utensil between capture of the two images may be determined. In some embodiments, these differences includes changes in utensil structure. Thus, 450 may include determining utensil deformation. Such deformation may correspond to variations in edge shape, curvature, surface area, or size (e.g., within an image) for the cooking utensil within or between the first and second captured images. In additional or alternative embodiments, the determined changes includes changes in utensil color. Thus, 450 may include determining utensil discoloration. Such discoloration may correspond to variations in pixel color, pixel brightness, or surface reflectivity for the cooking utensil within or between the first and second captured images. In further additional or alternative embodiments, the determined changes include the emergence or presence of visible gases. Thus, 450 may include determining gas emission from the cooking utensil. As an example, the presence of smoke (e.g., image distortion caused thereby) may be detected from the second captured image (e.g., while being absent from the first image).

At 460, the method 400 includes directing oven operation based on the detected changes. For instance, one or more actions on the oven appliance may be triggered in response to the detected changes. In some embodiments, an alert is initiated, which generally indicates, corresponds to, or communicates the changes in the cooking utensil. As an example, 460 may include transmitting an alert signal to the control panel (e.g., screen or speaker thereof), which initiates an alert (e.g., visual or audio alert tone, message, or icon) on the oven appliance. As an additional or alternative example, 460 may include transmitting an alert signal (e.g., wirelessly) to the user device, which initiates an alert (e.g., visual or audio alert tone, message, or icon) on the user device, as would be understood.

In some embodiments, the temperature within the oven appliance or heat output of one or more heating elements is adjusted (e.g., decreased) at 460. Optionally, one or all of the heating elements associated with the cooking chamber may be deactivated (e.g., to prevent damage to the utensil) at 460.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a cooking chamber;

a heating element in thermal communication with the cooking chamber to heat a cooking utensil therein; and a controller in operable communication with the heating element, the controller being configured to initiate a directed cooking operation comprising capturing a first image of the cooking chamber, analyzing the captured first image, analyzing the captured first image comprising identifying the cooking utensil within the cooking chamber based on the captured first image, and determining one or more first analyzed physical characteristics of the cooking utensil, capturing a second image of the cooking chamber following capturing the first image, analyzing the captured second image, analyzing the captured second image comprising reidentifying the cooking utensil within the cooking chamber based on the captured second image, and determining one or more second analyzed physical characteristics of the cooking utensil, comparing the analysis of the captured first image to the analysis of the captured second image, detecting changes in the cooking utensil based on the comparison, and directing oven operation based on the detected changes, wherein capturing the first image comprises receiving a first image signal from a discrete camera assembly directed at the cooking chamber, and wherein capturing the second image comprises receiving a second image signal from the discrete camera assembly directed at the cooking chamber.

2. The oven appliance of claim 1, wherein the cooking operation further comprises receiving an activation signal to activate one or more heating elements in thermal communication with the cooking chamber, and wherein capturing the first image is in response to receiving the activation signal.

3. The oven appliance of claim 1, wherein detecting changes comprises determining utensil deformation.

4. The oven appliance of claim 1, wherein detecting changes comprises determining utensil discoloration.

5. The oven appliance of claim 1, wherein detecting changes comprises determining gas emission from the cooking utensil.

6. The oven appliance of claim 1, wherein directing oven operation comprises initiating an alert on the oven appliance.

7. The oven appliance of claim 1, wherein directing oven operation comprises initiating an alert at a user device spaced apart from the oven appliance and in operable communication therewith.

8. The oven appliance of claim 1, wherein the discrete camera assembly is secured to the cabinet.

9. A method of operating an oven appliance defining a cooking chamber to receive a cooking utensil therein, the method comprising:

capturing a first image of the cooking chamber;

analyzing the captured first image, analyzing the captured first image comprising identifying the cooking utensil within the cooking chamber based on the captured first image, and determining one or more first analyzed physical characteristics of the cooking utensil;

capturing a second image of the cooking chamber following capturing the first image;

analyzing the captured second image, analyzing the captured second image comprising reidentifying the cooking utensil within the cooking chamber based on the captured second image, and determining one or more second analyzed physical characteristics of the cooking utensil;

comparing the analysis of the captured first image to the analysis of the captured second image;

detecting changes in the cooking utensil based on the comparison; and directing oven operation based on the detected changes, wherein capturing the first image comprises receiving a first image signal from a discrete camera assembly directed at the cooking chamber, and wherein capturing the second image comprises receiving a second image signal from the discrete camera assembly directed at the cooking chamber.

10. The method of claim 9, further comprising:

receiving an activation signal to activate one or more heating elements in thermal communication with the cooking chamber, wherein capturing the first image is in response to receiving the activation signal.

11. The method of claim 9, wherein detecting changes comprises determining utensil deformation.

12. The method of claim 9, wherein detecting changes comprises determining utensil discoloration.

13. The method of claim 9, wherein detecting changes comprises determining gas emission from the cooking utensil.

14. The method of claim 9, wherein directing oven operation comprises initiating an alert on the oven appliance.

15. The method of claim 9, wherein directing oven operation comprises initiating an alert at a user device spaced apart from the oven appliance and in operable communication therewith.

16. The method of claim 9, wherein the discrete camera assembly is secured to a cabinet of the oven appliance.

* * * * *